US009120319B2

(12) United States Patent
Yoneta

(10) Patent No.: US 9,120,319 B2
(45) Date of Patent: Sep. 1, 2015

(54) LIQUID DISCHARGE HEAD AND IMAGE FORMING APPARATUS

(71) Applicant: Ryohta Yoneta, Tokyo (JP)

(72) Inventor: Ryohta Yoneta, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 10 days.

(21) Appl. No.: 14/020,951

(22) Filed: Sep. 9, 2013

(65) Prior Publication Data

US 2014/0071215 A1 Mar. 13, 2014

(30) Foreign Application Priority Data

Sep. 13, 2012 (JP) ..... 2012-201353
Jun. 5, 2013 (JP) ..... 2013-118410

(51) Int. Cl.
*B41J 2/175* (2006.01)
*B41J 2/14* (2006.01)

(52) U.S. Cl.
CPC ..... *B41J 2/17563* (2013.01); *B41J 2/14274* (2013.01); *B41J 2002/14403* (2013.01)

(58) Field of Classification Search
CPC ..... B41J 2/17563
USPC ..... 347/93
See application file for complete search history.

(56) References Cited

U.S. PATENT DOCUMENTS 8,172,389 B2 5/2012 Sugahara
8,348,407 B2 1/2013 Matsufuji et al.
2001/0026306 A1* 10/2001 Yamazaki et al. ..... 347/86
2010/0328409 A1* 12/2010 Matsufuji et al. ..... 347/93

FOREIGN PATENT DOCUMENTS

JP 2008-183800 8/2008
JP 2011-025663 2/2011

OTHER PUBLICATIONS

U.S. Appl. No. 13/788,842, filed Mar. 7, 2013.

* cited by examiner

*Primary Examiner* — Manish S Shah
*Assistant Examiner* — Jeffrey C Morgan
(74) *Attorney, Agent, or Firm* — Cooper & Dunham LLP

(57) ABSTRACT

A liquid discharge head includes nozzles configured to discharge liquid droplets; individual flow paths to which the nozzles are connected; a liquid injection unit connected to the individual flow paths; a common liquid room configured to supply liquid to the individual flow paths; and a filter unit configured to filter the liquid. The filter unit is provided between the common liquid room and the liquid injection unit. The filter unit includes a reinforcement area for dividing the filter unit into filter areas each corresponding to two or more of the individual flow paths. A partition wall is provided corresponding to the reinforcement area of the filter unit, on the liquid injection unit side. A width in a nozzle arrangement direction of the partition wall is wider than a width in the nozzle arrangement direction of the reinforcement area.

5 Claims, 10 Drawing Sheets

LIQUID DISCHARGE HEAD AND IMAGE FORMING APPARATUS

BACKGROUND OF THE INVENTION

1. Field of the Invention

The present invention relates to a liquid discharge head and an image forming apparatus.

2. Description of the Related Art

As an image forming apparatus such as a printer, a fax machine, a copier, a plotter, and a multifunction peripheral including these functions, there is known an inkjet recording device that is an image forming apparatus of a liquid discharge recording method using a recording head constituted by liquid discharge heads (liquid droplet discharge heads) for discharging liquid droplets.

In a liquid discharge head, when foreign matter enters the liquid, droplet discharge failures occur. Therefore, the liquid discharge head is provided with a filter member for filtering the liquid in the flow path.

Conventionally, there is known a configuration in which a filter unit, which is for filtering the liquid, is provided across the entire area of a plurality of individual liquid rooms in the nozzle arrangement direction. The filter unit is provided between a liquid injection unit connected to all of a plurality of individual flow paths connected to nozzles, and a common liquid room. In the filter unit, a plurality of reinforcement ribs are formed at intervals corresponding to two or more liquid rooms in the nozzle arrangement direction. The filter unit is divided into a plurality of parts by the reinforcement ribs, and inter-liquid room partition walls are provided corresponding to the ribs (Patent Document 1).

Patent Document 1: Japanese Laid-Open Patent Publication No. 2011-025663

In the configuration disclosed in Patent Document 1, the width in the nozzle arrangement direction of the partition walls provided corresponding to the ribs is narrower than the width in the nozzle arrangement direction of the reinforcement ribs. Thus, stagnation occurs at the liquid injection unit side of the filter unit, and the bubble discharging property is decreased.

SUMMARY OF THE INVENTION

The present invention provides a liquid discharge head and an image forming apparatus, in which one or more of the above-described disadvantages are eliminated.

According to an aspect of the present invention, there is provided a liquid discharge head including a plurality of nozzles configured to discharge liquid droplets; a plurality of individual flow paths to which the plurality of nozzles are connected; a liquid injection unit connected to the plurality of individual flow paths; a common liquid room configured to supply liquid to the plurality of individual flow paths; and a filter unit configured to filter the liquid, the filter unit being provided between the common liquid room and the liquid injection unit, wherein the filter unit includes a reinforcement area for dividing the filter unit into a plurality of filter areas each corresponding to two or more of the plurality of individual flow paths, a partition wall is provided corresponding to the reinforcement area of the filter unit, on the liquid injection unit side, and a width in a nozzle arrangement direction of the partition wall is wider than a width in the nozzle arrangement direction of the reinforcement area.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of embodiments of the present invention.

Figure 1:
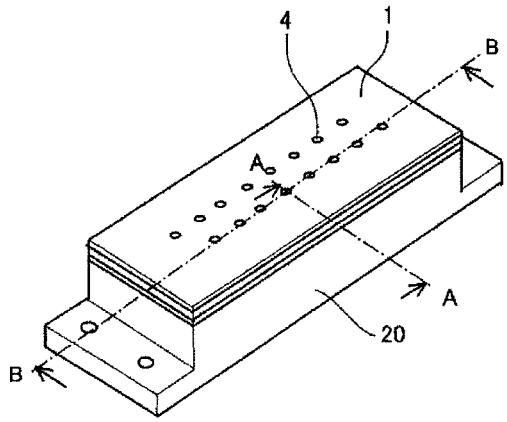
FIG. 1 is an external perspective view of a liquid discharge head according to a first embodiment of the present invention.
Figure 2:
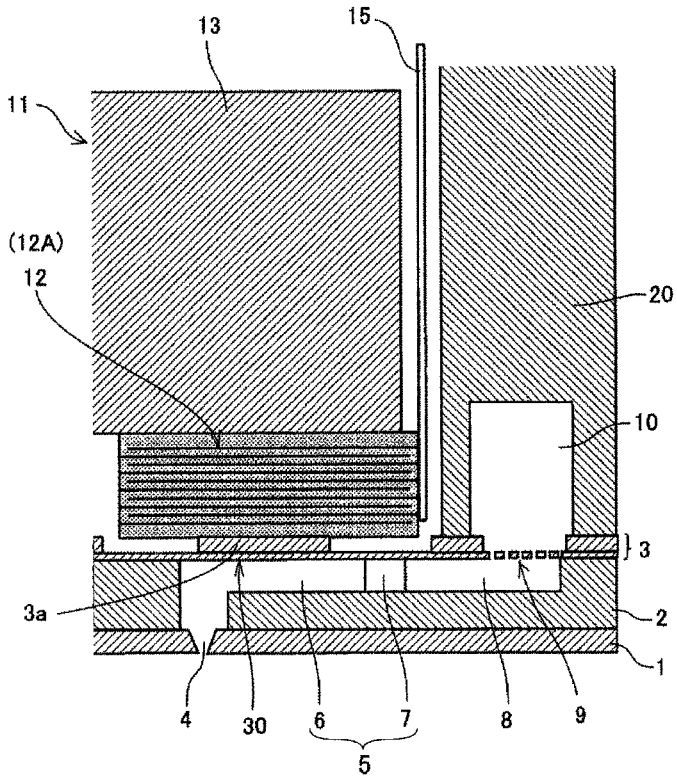
FIG. 2 is a cross-sectional view of the liquid discharge head cut along a direction (liquid room longitudinal direction) along a line A-A in FIG. 1 that is orthogonal to a nozzle arrangement direction.
Figure 3:
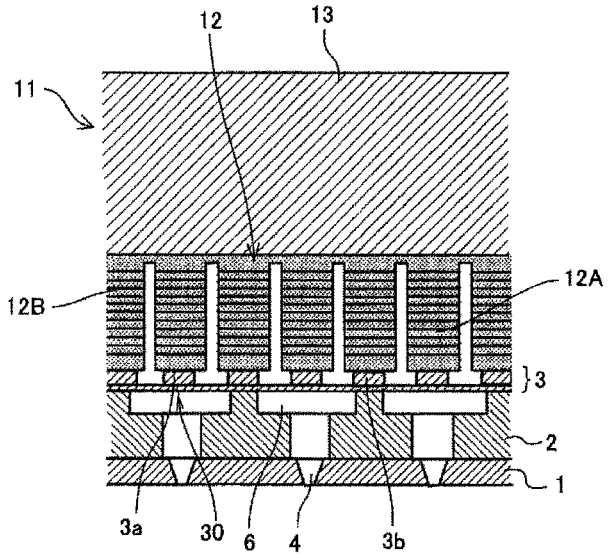
FIG. 3 is a cross-sectional view of the liquid discharge head cut along a nozzle arrangement direction (liquid room lateral direction) along a line B-B in FIG. 1.

A description is given of a liquid discharge head according to a first embodiment of the present invention, with references to FIGS. 1 through 4. FIG. 1 is an external perspective view of the liquid discharge head, FIG. 2 is a cross-sectional view of the liquid discharge head cut along a direction (liquid room longitudinal direction) along a line A-A in FIG. 1 that is orthogonal to a nozzle arrangement direction, and FIG. 3 is a cross-sectional view of the liquid discharge head cut along a nozzle arrangement direction (liquid room lateral direction) along a line B-B in FIG. 1.

In the liquid discharge head, a nozzle plate 1, a flow path plate (liquid room substrate) 2, and an oscillating plate member 3 acting as a thin film member are laminated and joined together. Furthermore, a piezoelectric actuator 11 for displacing the oscillating plate member 3, and a frame member 20 acting as a common flow path member are provided.

The nozzle plate 1, the flow path plate 2, and the oscillating plate member 3 form individual liquid rooms (also referred to as pressurizing liquid rooms, pressure rooms, pressurizing rooms, and flow paths) 6 which are respectively connected to a plurality of nozzles 4 for discharging liquid droplets, liquid supply paths 7 also acting as fluid resistance units for supplying liquid to the individual liquid rooms 6, and liquid injection units 8 connected to the liquid supply paths 7. In this example, individual flow paths 5 are constituted by the individual liquid rooms 6 and the liquid supply paths 7 including fluid resistance units. However, when there is no fluid resistance unit and the liquid injection units 8 are directly connected to the individual liquid rooms 6, the individual liquid rooms 6 act as individual flow paths.

The liquid is supplied from a common liquid room 10 acting as a common flow path of the frame member 20, through a filter unit 9 formed in the oscillating plate member 3, the liquid injection units 8, and the liquid supply paths 7, to the plurality of individual liquid rooms 6.

In this case, the nozzle plate 1 is made of a metal plate such as nickel (Ni), and manufactured by an electroforming method. The material is not so limited to the above; other materials such as a metal member, a resin member, and a laminated member including a resin layer and a metal layer may be used. In the nozzle plate 1, nozzles 4 having a diameter of, for example, 10 μm through 35 μm are formed corresponding to the individual liquid rooms 6, and the nozzle plate 1 is joined with the flow path plate 2 with an adhesive. On the liquid droplet discharging side of the nozzle plate 1 (surface of discharging direction: discharging side, or side opposite to individual liquid rooms 6), there is provided a water repellent layer.

In the flow path plate 2, groove parts constituting the individual liquid rooms 6, the liquid supply path 7, and the liquid injection units 8 are formed by etching a single-crystal silicon substrate. The flow path plate 2 may be formed by etching a metal plate such as a SUS substrate with an acidic etching liquid, or by performing machine processing such as pressing.

The oscillating plate member 3 also acts as a wall member forming the walls of the individual liquid rooms 6 in the flow path plate 2, and includes deformable oscillating areas 30 at parts corresponding to the individual liquid rooms 6.

Furthermore, on the oscillating plate member 3 on the side opposite to the individual liquid rooms 6, the piezoelectric actuator 11 is disposed, which includes an electromechanical conversion element acting as a driving unit (actuator unit, pressure generating unit) for deforming the oscillating areas 30 of the oscillating plate member 3.

The piezoelectric actuator 11 includes a plurality of laminated piezoelectric members 12 which are joined by an adhesive provided on a base member 13. Each piezoelectric member 12 is groove-processed by half cut dicing to form a required number of piezoelectric pillars 12A, 12B at predetermined intervals in a comb-tooth form in each piezoelectric member 12.

The piezoelectric pillars 12A, 12B of the piezoelectric member 12 are the same; however, a distinction is made in that the driven piezoelectric pillar (driven pillar) 12A is driven by applying driving waves, and the non-driven piezoelectric pillar (non-driven pillar) 12B is simply a support pillar used without applying driving waves.

The driven pillar 12A is joined to an island-shaped protrusion part 3*a* formed in the oscillating area 30 of the oscillating plate member 3. The non-driven pillar 12B is joined to a protrusion part 3*b* on the oscillating plate member 3.

The piezoelectric member 12 is formed by alternately laminating piezoelectric layers and internal electrodes. The internal electrodes are drawn out to the edge face to provide external electrodes. The external electrodes are connected to an FPC (flexible printed circuit) 15 acting as a flexible wiring substrate having flexibility, for applying driving signals to the external electrodes of the driven pillar 12A.

The frame member 20 is formed by injection molding with, for example, epoxy resin or polyphenylene sulfite that is a thermoplastic resin, and the common liquid room 10 is formed, to which liquid is supplied from a head tank or a liquid cartridge (not shown).

In a liquid jetting head having the above configuration, for example, the voltage applied to the driven pillar 12A is decreased from a standard potential, and accordingly, the driven pillar 12A contracts, and the oscillating area 30 of the oscillating plate member 3 declines, so that the volume of the individual liquid room 6 expands and liquid flows inside the individual liquid room 6. Subsequently, the voltage applied to the driven pillar 12A is increased to extend the driven pillar 12A in the lamination direction, and the oscillating area 30 of the oscillating plate member 3 is deformed in the nozzle 4 direction, so that the volume of the individual liquid room 6 is reduced. Accordingly, pressure is applied to the liquid inside the individual liquid room 6, and liquid droplets are discharged (jetted) from the nozzle 4.

Then, by changing the voltage applied to the driven pillar 12A back to the standard potential, the oscillating area 30 of the oscillating plate member 3 returns to the initial position, and the individual liquid room 6 expands and a negative pressure is generated. Accordingly, at this time, the individual liquid room 6 is filled with liquid flowing from the common liquid room 10 through the liquid supply path 7. Then, after the oscillation of the meniscus surface of the nozzle 4 attenuates and stabilizes, the next operation for discharging liquid droplets is started.

The method of driving a head is not limited to the above example (drawing-pushing striking); depending on the method of applying a driving waveform, pulling striking and pushing striking may be performed.

Figure 4:
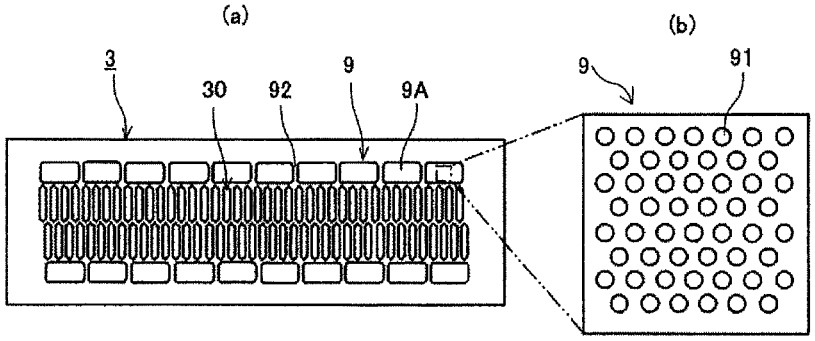
FIG. 4 is a plan view and an enlarged view of relevant parts of an oscillating plate member used for describing the first embodiment.
Figure 5:
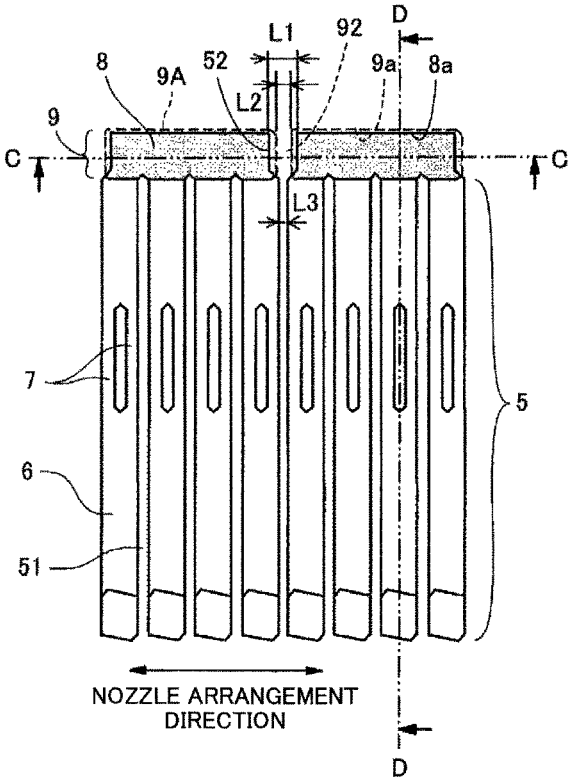
FIG. 5 is a plan view of a flow path part of the liquid discharge head according to the first embodiment.
Figure 6:
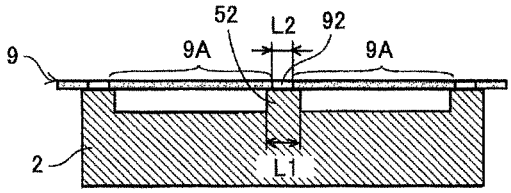
FIG. 6 is a cross-sectional view cut along a line C-C in FIG. 5.

Next, the first embodiment of the present invention is described with reference to FIGS. 4 through 6. FIG. 4 is a plan view and an enlarged view of relevant parts of the oscillating plate member 3 used for describing the first embodiment. FIG. 5 is a plan view of the flow path part. FIG. 6 is a cross-sectional view cut along a line C-C in FIG. 5. In FIG. 5, the filter area is filled in to make the diagram easily viewable (the same applies to following diagrams).

First, as illustrated in FIG. 4, in the oscillating plate member 3, the filter unit 9 for filtering liquid is provided between the common liquid room 10 and the liquid injection unit 8, and multiple filter holes 91 through which the liquid passes are formed in the filter unit 9. In the filter unit 9, reinforcement areas 92 are provided, and the filter unit 9 is divided into a plurality of filter areas 9A each corresponding to two or more individual flow paths 5.

As illustrated in FIG. 5, between the plurality of individual flow paths 5, partition walls 51 functioning as dividers are provided.

Each reinforcement area 92 of the filter unit 9 is provided at a position corresponding to one of the partition walls 51 between the individual flow paths 5, in the individual flow path arrangement direction (which is also the nozzle arrangement direction).

Furthermore, partition walls 52, which are for dividing the liquid injection unit 8 corresponding to the filter areas 9A, are provided on the liquid injection unit 8 side at the reinforcement areas 92 of the filter unit 9. Each of these partition walls 52 are formed by extending one of the partition walls 51 between the individual flow paths 5.

A width L1 in the nozzle arrangement direction of the partition wall 52 is wider than a width L2 in the nozzle arrangement direction of the reinforcement area 92 of the filter unit 9 (L1>L2). Furthermore, the width L1 in the nozzle arrangement direction of the partition wall 52 is wider than a width L3 in the nozzle arrangement direction of the partition wall 51 between the individual flow paths 5 on the downstream side with respect to the liquid injection unit 8 (L1>L3).

Figure 7:
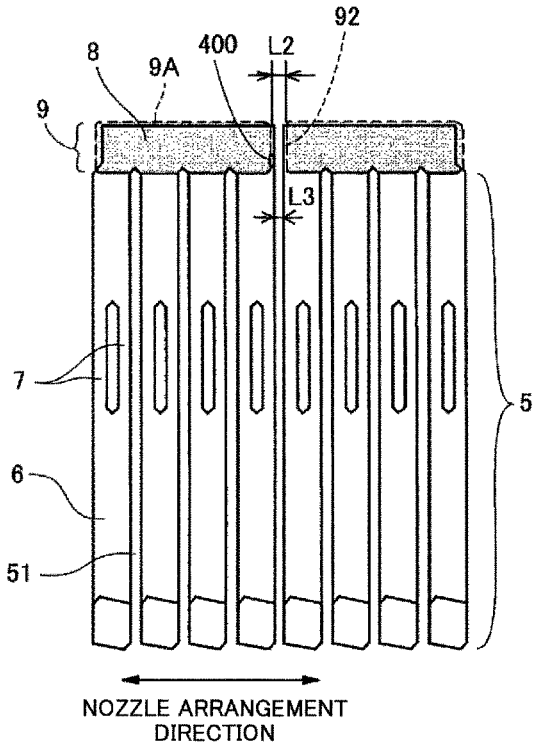
FIG. 7 is a plan view of a flow path part of comparative example 1.

A description is given of a comparative example 1 with reference to FIG. 7. FIG. 7 is a plan view of the flow path part of comparative example 1.

In comparative example 1, the partition walls 51 between the individual flow paths 5 are extended by the same width, corresponding to the reinforcement areas 92 of the filter unit 9. The width L3 in the nozzle arrangement direction of the partition wall 51 between the individual flow paths 5 is narrower than the width L2 in the nozzle arrangement direction of the reinforcement area 92 of the filter unit 9 (L3<L2).

Thus, in comparative example 1, on the liquid injection unit 8 side of the reinforcement area 92 of the filter unit 9, a stagnation area in the flow is generated. When bubbles 400 are retained in the stagnation area, it is difficult to discharge the bubbles 400.

Meanwhile, in the present embodiment, the width L1 in the nozzle arrangement direction of the partition wall 52 is wider than the width L2 in the nozzle arrangement direction of the reinforcement area 92 of the filter unit 9 (L1>L2). Therefore, a stagnation area in the flow is not generated on the liquid injection unit 8 side of the reinforcement area 92 of the filter unit 9, and bubbles are not retained.

Accordingly, by supplying liquid by applying pressure and suctioning, the flow of the liquid is generated across the entire area of the filter unit 9, so that bubbles that have entered the liquid can be easily discharged, thereby improving the bubble discharging property.

As described above, in the filter unit 9, there are the reinforcement areas 92 dividing the filter unit 9 into the plurality of filter areas 9A each corresponding to two or more of the individual flow paths 5. On the liquid injection unit 8 side, the partition walls 52 are provided at the reinforcement areas 92 the filter unit 9. The width in the nozzle arrangement direction of the partition wall 52 is wider than the width in the nozzle arrangement direction of the reinforcement area 92. Therefore, the bubble discharging property is improved.

Figure 8:
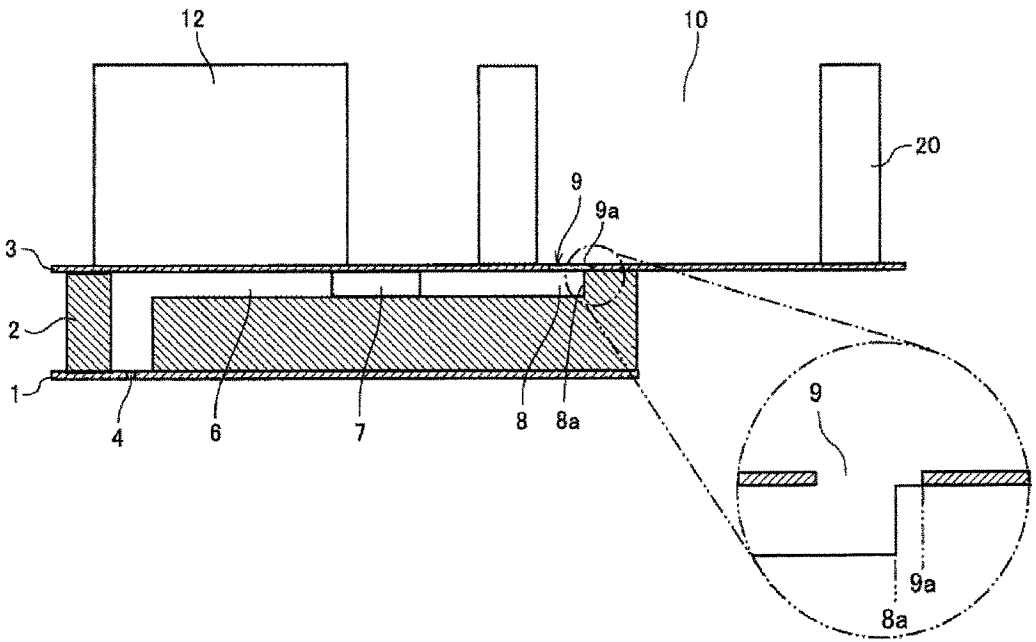
FIG. 8 is a cross-sectional view cut along a direction (liquid room longitudinal direction) along a line D-D in FIG. 5 that is orthogonal to a nozzle arrangement direction and an enlarged view of relevant parts of a liquid discharge head according to a second embodiment of the present invention.

Next, a description is given of a liquid discharge head according to a second embodiment of the present invention, with reference to FIG. 8 and FIG. 5 described above. FIG. 8 is a cross-sectional view cut along a direction (liquid room longitudinal direction) along a line D-D in FIG. 5 that is orthogonal to a nozzle arrangement direction and an enlarged view of relevant parts of a liquid discharge head according to the second embodiment of the present invention. Note that to make the diagram easily viewable, the filter area is blank in the enlarged view of relevant parts.

In the present embodiment, in a direction orthogonal to the nozzle arrangement direction, an edge part 8*a* of the liquid injection unit 8 on the side opposite to the individual flow path 5, is positioned (sticking out) closer to the individual flow path 5, than an edge part 9*a* of the filter unit 9 on the side opposite to the individual flow path 5.

Accordingly, there is no stagnation area on the liquid injection unit 8 side of the edge part 9*a* in the direction orthogonal to the nozzle arrangement direction of the filter unit 9, and the bubble discharging property improved. Furthermore, the joining area between the flow path plate 2 and the filter unit 9 is increased, and therefore the filter unit 9 is reinforced.

Figure 9:
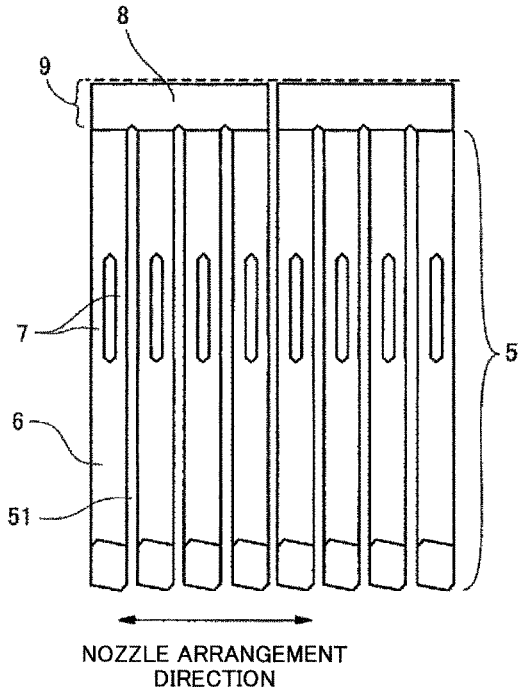
FIG. 9 is a plan view of the flow path part of a liquid discharge head according to a third embodiment of the present invention.

Next, a description is given of a liquid discharge head according to a third embodiment of the present invention, with reference to FIG. 9. FIG. 9 is a plan view of the flow path part of the liquid discharge head according to the third embodiment.

In the present embodiment, a reinforcement area is not provided in the filter unit 9. The partition walls 51 are extended by the same width to the liquid injection unit 8, and are directly joined to the filter unit 9.

In this example, not all of the partition walls 51 between the individual flow paths 5 are extended. The partition walls 51 at every several number of partition walls 51 are extended; that is to say, the partition walls 51 are extended so that there are two or more individual flow paths 5 between the extended partition walls 51.

In this case, there is no reinforcement area where stagnation occurs on the liquid injection unit 8 side of the filter unit 9. Therefore, even if the partition walls 51 are extended, there is no stagnation area, thereby improving the bubble discharging property.

Figure 10:
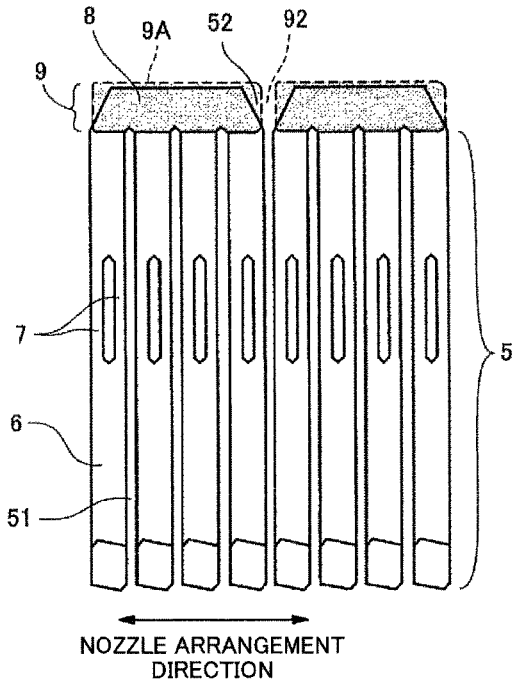
FIG. 10 is a plan view of the flow path part of a liquid discharge head according to a fourth embodiment of the present invention.

Next, a description is given of a liquid discharge head according to a fourth embodiment of the present invention, with reference to FIG. 10. FIG. 10 is a plan view of the flow path part of the liquid discharge head according to the fourth embodiment.

In the present embodiment, the width of the partition wall 52 in the nozzle arrangement direction increases in a direction away from the individual flow path 5 which is a direction orthogonal to the nozzle arrangement direction. In this example, in a planar view, both edge surfaces in the nozzle arrangement direction of the partition wall 52 are formed in an oblique shape.

Also with the above configuration, a stagnation area is not generated in the flow on the liquid injection unit 8 side of the reinforcement area 92 of the filter unit 9, and bubbles are not retained.

Figure 11:
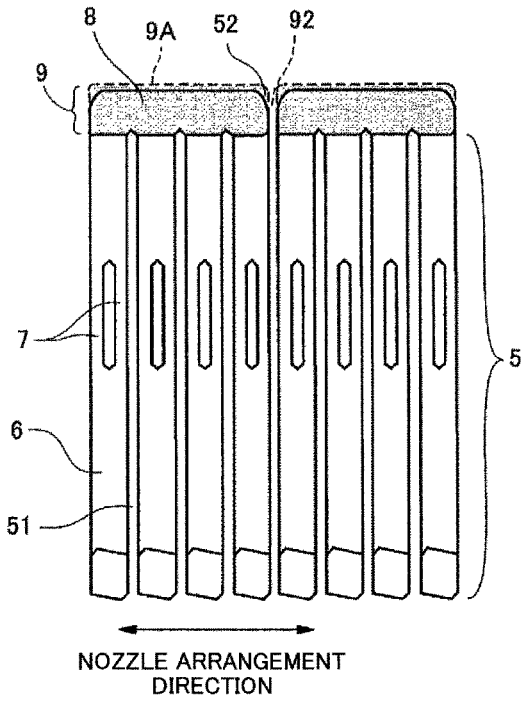
FIG. 11 is a plan view of the flow path part of a liquid discharge head according to a fifth embodiment of the present invention.

Next, a description is given of a liquid discharge head according to a fifth embodiment of the present invention, with reference to FIG. 11. FIG. 11 is a plan view of the flow path part of the liquid discharge head according to the fifth embodiment.

In the present embodiment also, the width of the partition wall 52 in the nozzle arrangement direction increases in a direction away from the individual flow path 5 which is a direction orthogonal to the nozzle arrangement direction. In this example, in a planar view, both edge surfaces in the nozzle arrangement direction of the partition wall 52 are formed in a curved shape.

Also with the above configuration, a stagnation area is not generated in the flow on the liquid injection unit 8 side of the reinforcement area 92 of the filter unit 9, and bubbles are not retained.

Figure 12:
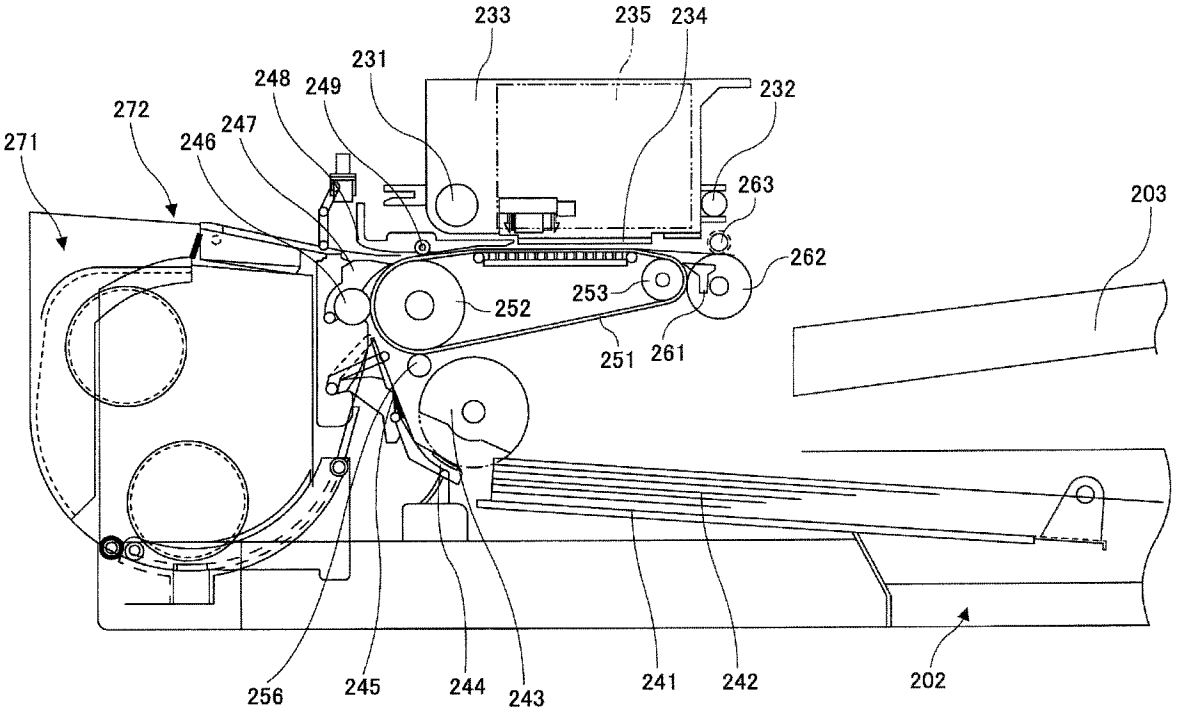
FIG. 12 is a side view of the mechanism part of an image forming apparatus according to an embodiment of the present invention.
Figure 13:
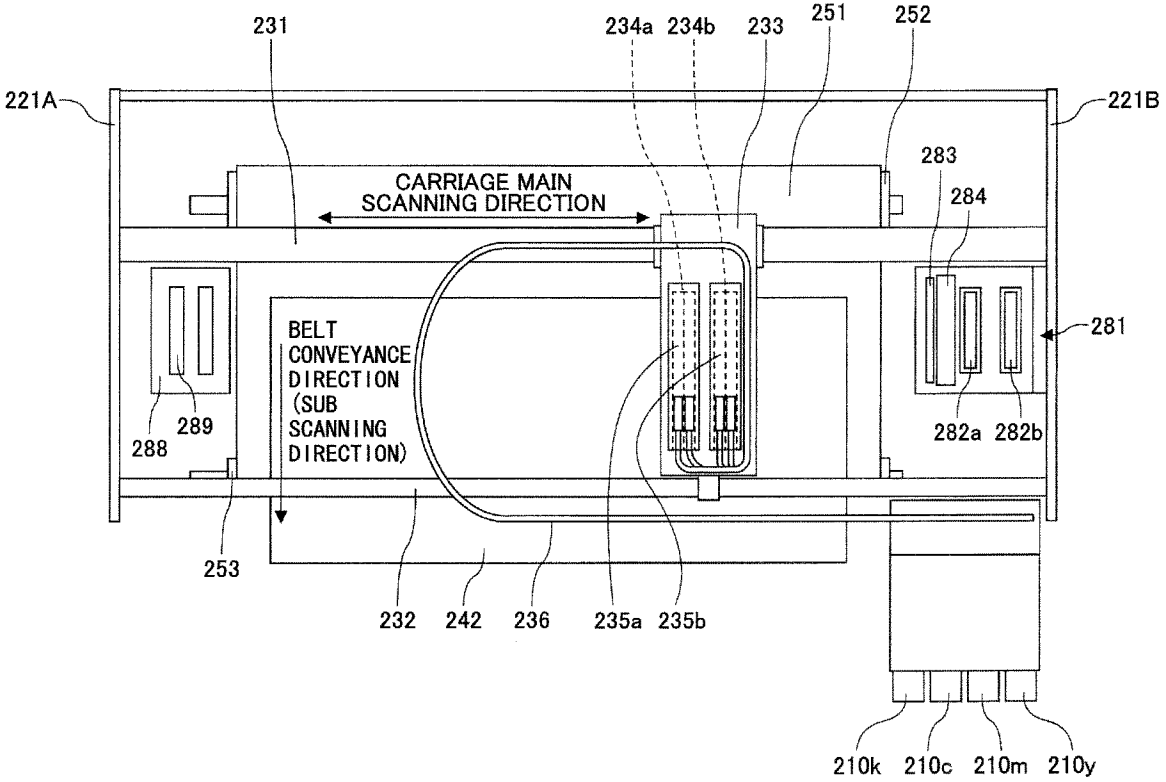
FIG. 13 is a plan view of relevant parts of the mechanism part of FIG. 12.

Next, a description is given of an example of an image forming apparatus according to an embodiment of the present invention including a liquid discharge head according to an embodiment of the present invention, with reference to FIGS. 12 and 13. FIG. 12 is a side view of the mechanism part of the image forming apparatus, and FIG. 13 is a plan view of relevant parts of the mechanism part.

This image forming apparatus is a serial type. According to this image forming apparatus, a carriage 233 is held with a primary (main) guide rod 231 and a secondary (sub) guide rod 232, which are guide members extending between left and right side plates 221A and 221B, so as to be slidable in the main scanning directions, and the carriage 233 is caused to move and scan in the directions indicated by an arrow in FIG. 13 (carriage main scanning directions) by a main scanning motor (not illustrated) through a timing belt.

Recording heads 234*a* and 234*b* for discharging ink droplets of yellow (Y), cyan (C), magenta (M), and black (K) colors are attached to the carriage 233 with their multiple nozzles being arranged in arrays in the sub scanning direction perpendicular to the main scanning direction and their nozzle surfaces (discharge surfaces) facing downward so that ink droplets are discharged downward. (The recording heads 234*a* and 234*b* may be collectively referred to by reference numeral "234" when no distinction is made therebetween.) Each recording head 234 is formed of a liquid discharge head according to an embodiment of the present invention, and a tank for accommodating ink to be supplied to the head, which are combined together.

Each recording head 234 has two nozzle arrays. One nozzle array of the recording head 234*a* discharges liquid droplets of black (K), and the other nozzle array of the recording head 234*a* discharges liquid droplets of cyan (C). One nozzle array of the recording head 234*b* discharges liquid droplets of magenta (M), and the other nozzle array of the recording head 234*b* discharges liquid droplets of yellow (Y). In this example, four colors of liquid droplets are discharged by a two-head configuration; however, there may be four nozzles arranged in one head, and one head may be used for discharging four colors.

Further, head tanks (sub tanks) 235*a* and 235*b* for supplying color inks to the corresponding nozzle arrays of the recording heads 234*a* and 234*b*, respectively, are provided on the carriage 233. (The head tanks 235*a* and 235*b* may be collectively referred to by reference numeral "235" when no distinction is made therebetween.) The color inks are supplied from corresponding ink cartridges 210*k*, 210*c*, 210*m*, and 210*y* to the corresponding head tanks 235 through corresponding supply tubes 236.

On the other hand, as a paper feed part for feeding paper 242 stacked on a paper stacking part (platen) 241 of a paper feed tray 202, the image forming apparatus includes a semilunar roller (paper feed roller) 243 that separates and feeds sheets of the paper 242 one by one from the paper stacking part 241 and a separation pad 244 formed of a material having a high coefficient of friction and disposed opposite the paper feed roller 243. The separation pad 244 is urged toward the paper feed roller 243 side.

Further, the image forming apparatus includes a guide member 245 that guides the paper 242, a counter roller 246, a conveyance guide member 247, and a pressing member 248 including an edge pressure roller 249 in order to feed the paper 242 fed from the paper feed part to a position below the recording heads 234. Further, the image forming apparatus also includes a conveyor belt 251 serving as a conveyor part for conveying the fed paper 242 into a position opposing the recording heads 234 by having the fed paper 242 electrostatically attracted and adhered thereto.

This conveyor belt 251 is an endless belt, and is engaged with and provided between a conveyor roller 252 and a tension roller 253 so as to rotate in a belt conveyance direction (sub scanning direction). Further, the image forming apparatus includes a charging roller 256 serving as a charger for charging the surface of the conveyor belt 251. The charging roller 256 is disposed in contact with the surface layer of the conveyor belt 251 so as to be rotated by the rotation of the conveyor belt 251. The conveyor belt 251 is caused to rotate in the belt conveyance direction by the conveyor roller 252 being rotated by a sub scanning motor (not illustrated) through a timing belt.

The image forming apparatus further includes a separation claw 261 for separating the paper 242 from the conveyor belt 251, a paper output roller 262, and a paper output roller 263 as a paper output part for outputting (ejecting) the paper 242 subjected to recording with the recording heads 234. The image forming apparatus also includes a paper output tray 203 below the paper output roller 262.

The image forming apparatus includes a duplex unit 271 detachably attached to the rear part of an apparatus main body. The duplex unit 271 takes in the paper 242 returned by the reverse rotation of the conveyor belt 251. Then, the duplex unit 271 reverses the paper 242, and feeds the reversed paper 242 again in between the counter roller 246 and the conveyor belt 251. The upper surface of the duplex unit 271 serves as a manual feed tray 272.

Further, a maintenance and recovery mechanism 281 for the head according to an embodiment of the present invention, serving as a head maintenance and recovery unit including a recovery part for maintaining and restoring the nozzle status of the recording heads 234, is disposed in one of non-printing areas in the scanning directions of the carriage 233. The maintenance and recovery mechanism 281 includes cap members (hereinafter referred to as "caps") 282*a* and 282*b* for capping the nozzle surfaces of the recording heads 234*a* and 234*b*, respectively, a wiper blade 283 serving as a blade member for wiping the nozzle surfaces, and a blank discharge (flushing) reception member 284 that receives liquid droplets at the time of flushing or discharging liquid droplets that do not contribute to recording in order to discharge recording liquid with increased viscosity.

Further, a blank ejection receiver 288, serving as a liquid collection container that receives liquid droplets at the time of flushing or discharging liquid droplets that do not contribute recording in order to discharge recording liquid with increased viscosity during recording, is disposed in the other one of the non-printing areas in the scanning directions of the carriage 233. The blank ejection receiver 288 includes openings 289 elongated along the directions of the nozzle arrays of the recording heads 234.

According to the image forming apparatus thus configured, sheets of the paper 242 are separated and fed one by one from the paper feed tray 202. The paper 242 fed upward in a substantially vertical direction is guided by the guide 245 to be conveyed, held between the conveyor belt 251 and the counter roller 246. Further, the paper 242 has its leading edge guided by the conveyance guide member 217 to be pressed against the conveyor belt 251 by the edge pressure roller 249, so that the conveying direction of the paper 242 is changed by substantially 90°.

At this point, positive output and negative output are alternately applied repeatedly, that is, an alternating voltage is applied, to the charging roller 256, so that the conveyor belt 251 has alternating charging voltage patterns, that is, the conveyor belt 251 is charged so as to have alternate belt-like patterns, each of a predetermined width, of positively charged parts and negatively charged parts in the sub scanning direction that is the rotating direction. When the paper 242 is fed onto this conveyor belt 251 charged alternately positively and negatively, the paper 242 is attracted and adhered to the conveyor belt 251, and is conveyed in the sub scanning direction by the rotation of the conveyor belt 251.

Then, the recording heads 234 are driven in accordance with an image signal while moving the carriage 233, thereby discharging ink droplets onto the paper 242 at rest and performing one line's worth of recording. Then, after conveying the paper 242 by a predetermined amount, the next line is recorded. In response to reception of a recording end signal or a signal indicating that the trailing edge of the paper 212 has reached a recording area, the recording operation ends and the paper 242 is output onto the paper output tray 203.

By having a liquid discharge head according to an embodiment of the present invention, such an image forming apparatus is able to record a high-quality image in a stable manner.

In the present application, a "sheet" is not limited to be made of a paper material; the sheet may be made of an OHP, cloth, glass and a substrate, on which ink droplets and other liquid may adhere, which is also referred to a recording medium, a recording paper, and a recording sheet. Furthermore, image forming, recording, and printing, are used as synonyms.

The term "image forming apparatus" means an apparatus that performs image forming by discharging liquid onto media such as paper, thread, textile, cloth, leather, metal, plastic, glass, wood, and ceramics. The term "image forming" means not only providing media with significant images such as letters, characters, and figures, but also providing media with insignificant images such as patterns (simply meaning to make liquid droplets land on the medium).

Further, the term "ink" is not limited to ink, but ink is a collective term of all kinds of liquid with which images can be formed, including recording liquid, fixing processing liquid, and liquid. Examples include a DNA sample, resist, a pattern material, and resin.

The term "image" is not limited to a planar image; an image may be three-dimensionally formed on the sheet, or a three-dimensional object may be formed on the sheet.

An image forming apparatus may be a serial type image forming apparatus or a line type image forming apparatus unless specifically limited.

According to one embodiment of the present invention, a liquid discharge head and an image forming apparatus are provided, by which the bubble discharging property can be improved.

The liquid discharge head and the image forming apparatus are not limited to the specific embodiments described herein, and variations and modifications may be made without departing from the scope of the present invention.

The present application is based on and claims the benefit of priority of Japanese Priority Patent Application No. 2012-201353, filed on Sep. 13, 2012 and Japanese Priority Patent Application No. 2013-118410, filed on Jun. 5, 2013, the entire contents of which are hereby incorporated herein by reference.

What is claimed is:

1. A liquid discharge head comprising:

a plurality of nozzles configured to discharge liquid droplets;

a plurality of individual flow paths to which the plurality of nozzles are connected;

a liquid injection unit connected to the plurality of individual flow paths;

a common liquid room configured to supply liquid to the plurality of individual flow paths; and a filter unit configured to filter the liquid, the filter unit being provided between the common liquid room and the liquid injection unit, wherein the filter unit includes a reinforcement area for dividing the filter unit into a plurality of filter areas each corresponding to two or more of the plurality of individual flow paths, a partition wall is provided corresponding to the reinforcement area of the filter unit, on the liquid injection unit side, and a width in a nozzle arrangement direction of the partition wall is wider than a width in the nozzle arrangement direction of the reinforcement area.

2. The liquid discharge head according to claim 1, wherein a partition wall is provided between the plurality of individual flow paths, and the width in the nozzle arrangement direction of the partition wall corresponding to the reinforcement area of the filter unit is wider than a part of the partition wall between the plurality of individual flow paths on a downstream side of the liquid injection unit.

3. The liquid discharge head according to claim 1, wherein the width in the nozzle arrangement direction of the partition wall corresponding to the reinforcement area of the filter unit increases in a direction away from the plurality of individual flow paths.

4. The liquid discharge head according to claim 1, wherein in a direction orthogonal to the nozzle arrangement direction, an edge part of the liquid injection unit on a side opposite to the plurality of individual flow paths is positioned closer to the plurality of individual flow paths than an edge part of the filter unit on a side opposite the plurality of individual flow paths.

5. An image forming apparatus comprising:

the liquid discharge head according to claim 1.

* * * * *